US007832825B2

(12) United States Patent
Kim et al.

(10) Patent No.: US 7,832,825 B2
(45) Date of Patent: Nov. 16, 2010

(54) NOZZLE ERROR CORRECTION METHOD AND IMAGE-FORMING APPARATUS USING THE SAME

(75) Inventors: Jung-Wook Kim, Suwon-si (KR); Eul-hwan Lee, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 427 days.

(21) Appl. No.: 11/322,563

(22) Filed: Jan. 3, 2006

(65) Prior Publication Data

US 2006/0279598 A1 Dec. 14, 2006

(30) Foreign Application Priority Data

Jun. 10, 2005 (KR) ..... 10-2005-0049787

(51) Int. Cl.
*B41J 2/205* (2006.01)

(52) U.S. Cl. ..... 347/15

(58) Field of Classification Search ..... 347/15, 347/19

See application file for complete search history.

(56) References Cited

U.S. PATENT DOCUMENTS 6,439,683 B1 * 8/2002 Matsumoto et al. ..... 347/15
6,443,548 B1 * 9/2002 Takayama et al. ..... 347/14
2004/0252148 A1 * 12/2004 Shibata et al. ..... 347/14
2005/0052488 A1 * 3/2005 Inoue ..... 347/19
2005/0185005 A1 * 8/2005 Yamazaki et al. ..... 347/6

FOREIGN PATENT DOCUMENTS

| | | |
|---|---|---|
| CN | 1421315 | 6/2003 |
| CN | 1509234 | 6/2004 |
| JP | 2002-172767 | 6/2002 |
| JP | 2003-118149 | 4/2003 |
| JP | 2004-175006 | 6/2004 |
| JP | 2004-284279 | 10/2004 |

* cited by examiner

*Primary Examiner*—Matthew Luu
*Assistant Examiner*—Justin Seo
(74) *Attorney, Agent, or Firm*—Roylance, Abrams, Berdo & Goodman, L.L.P.

(57) ABSTRACT

The nozzle error correction method is provided for adjusting information of an output image to correct an error nozzle. A position of an error nozzle firing an ink amount different from a reference value is detected from a plurality of nozzles. A determination is made from an input image as to whether a current pixel for output is an error pixel of the detected error nozzle. A channel value of the error nozzle is set to a certain value if the current pixel is the error pixel. However, if the current pixel is not the error pixel, a determination is made as to whether an error pixel exists in a certain area around the current pixel. A value of the current pixel is then adjusted based on error information. Image-processing is performed in order for the current pixel to be outputted, if the error pixel exists in the certain area. Accordingly, degradation of a print speed and a shortened life span of the head are prevented.

4 Claims, 4 Drawing Sheets

NOZZLE ERROR CORRECTION METHOD AND IMAGE-FORMING APPARATUS USING THE SAME

CROSS-REFERENCE TO RELATED APPLICATIONS

This application claims benefit under 35 U.S.C. §119(a) of Korean Patent Application No. 2005-49787, filed on Jun. 10, 2005 in the Korean Intellectual Property Office, the entire disclosure of which is hereby incorporated by reference.

BACKGROUND OF THE INVENTION

1. Field of the Invention

The present invention relates to a nozzle error correction method and an image-forming apparatus using the same. More particularly, the present invention relates to a nozzle error correction method and an image-forming apparatus using the same that detects an error pixel including an error nozzle and adjusts a value of the error pixel to correct the error nozzle.

2. Description of the Related Art

An ink-jet image-forming apparatus is a device for printing desired images on paper by firing ink through nozzles disposed in an array on a head. The nozzles are mechanical parts which can cause errors, such as a different ink-firing amount from that required in a design, or no ink firing from the nozzles. The errors from the nozzles result from defects during the image-forming apparatus manufacturing process or aging caused by fatigue. As a result, the nozzle error causes a degradation of quality printout images.

The conventional nozzle error correction method detects error nozzle position information and corrects the error nozzle by the head controller using the error nozzle position information. Such nozzle error correction method includes moving the head mechanically and placing a normal nozzle at the error nozzle position, controlling the time for an error nozzle to fire ink, and so on.

FIGS. 1A and 1B are views for explaining a conventional nozzle error correction method for mechanically moving the head and placing a normal nozzle at an error nozzle position. FIG. 1A is a view that illustrates all normal nozzles disposed in a row, and FIG. 1B is a view that illustrates nozzles disposed in a row and having an error nozzle therein.

In FIG. 1A, if an error nozzle is not detected, the head with a series of nozzles disposed thereon prints images by moving in a perpendicular direction to a paper movement.

In FIG. 1B, if an error nozzle is detected, the head moves in a perpendicular direction to a paper movement so that the normal nozzle is disposed at the position of the error nozzle and fires ink instead of the error nozzle.

In the conventional nozzle error correction method, a head-controlling circuit uses error nozzle position information and corrects the error nozzle. However, according to the conventional method, the head is moved in order for the normal nozzle to fire ink instead of the error nozzle. As a result, the normal nozzle accumulates fatigue and will likely become an error nozzle.

Further, the conventional nozzle error correction method using the head reduces print speed and shortens the life span of the head, since mechanical and image printout operations are required for the head.

Further, the nozzle error correction method that mechanically moves the head cannot be applied to image-forming apparatuses using a full-type head. The full-type head has a fixed position and performs printing by using a number of nozzles that correspond to a paper size. Thus, the mechanical moving of the head in the nozzle error correction method cannot be applied thereto.

Accordingly, there is a need for an improved nozzle error correction method that corrects an error nozzle caused by an output error pixel of the error nozzle.

SUMMARY OF THE INVENTION

An aspect of embodiments of the present invention is to address at least the above problems and/or disadvantages and to provide at least the advantages described below. Accordingly, an aspect of embodiments of the present invention is to provide a nozzle error correction method and an image-forming apparatus using the same that detects an error pixel including an error nozzle and adjusts a value of the error pixel to correct the error nozzle.

The foregoing and other objects and advantages are substantially realized by providing an error nozzle correction method. A position of an error nozzle firing an ink amount different from a reference value is detected from a plurality of nozzles. A determination is made from an input image as to whether a current pixel for output is an error pixel of the detected error nozzle. A channel value of the error nozzle is set to a certain value, if the current pixel is the error pixel, and if the current pixel is not the error pixel, a determination is made whether an error pixel exists in a certain area around the current pixel. A value of the current pixel based on error information is adjusted, and image-processing is performed in order for the current pixel to be outputted, if the error pixel exists in the certain area.

The error information is preferably at least one of a distance between an error pixel existing in the certain area and the current pixel, a value of the error pixel, or a value of the current pixel.

Preferably, the image-processing processes the current pixel in order for the current pixel to be outputted without adjustment of the value of the current pixel, if the error pixel does not exist in the certain area.

Preferably, the error nozzle correction method further determines whether the current pixel is the last pixel. If the current pixel is not the last pixel, a nozzle error correction is performed on a next pixel inputted after the current pixel, and if the current pixel is the last pixel, image output terminates.

The foregoing and other objects and advantages are substantially realized by providing a nozzle error correction method applicable to a predictable output with respect to a specific input using an error nozzle. A position of an error nozzle firing an ink amount different from a reference value is detected from a plurality of nozzles. A determination is made from an input image as to whether a current pixel for output is an error pixel using the detected error nozzle. A value of the current pixel is adjusted based on a difference between a pixel value predicted from the error pixel and a pixel value at the time a normal nozzle is used for the error pixel, if the current pixel is an error pixel. Image-processing is performed in order for a current pixel having the adjusted pixel value to be outputted.

The foregoing and other objects and advantages are substantially realized by providing an image-forming apparatus using a nozzle error correction method. An error nozzle detection unit detects from a plurality of nozzles, a position of an error nozzle firing an ink amount that is different from a reference value. A decision unit determines from an input image, whether a current pixel for output is an output error pixel of the error nozzle, and whether an error pixel exists in a certain area around the current pixel. A color correction unit sets a channel value of the error nozzle to a certain value in order to adjust a value of the current pixel, if the current pixel is the error pixel. If the current pixel is not the error pixel and an error pixel exists in the certain area around the current pixel, a value of the current pixel is adjusted based on error information. An image-processing unit performs image processing in order for the current pixel to be outputted.

Preferably, the image-forming apparatus includes a storage unit that stores input image data, position information of the detected error nozzle, and a certain channel value of the error nozzle.

The error information is at least one of a distance between the current pixel and an error pixel existing in the certain area around the current pixel, a value of the error pixel existing in the certain area, or a value of the current pixel.

The foregoing and other objects and advantages are substantially realized by providing an image-forming apparatus using a nozzle error correction method. An error nozzle detection unit detects from a plurality of nozzles, a position of an error nozzle firing an ink amount that is different from a reference value. A decision unit determines from an input image, whether the current pixel for output is an output error pixel of an error nozzle by using the error nozzle position information. A storage unit stores the error nozzle position information and information of a correction pixel value for each error pixel corresponding to the error nozzle position. A color correction unit corrects a value of the current pixel by using the information of a correction pixel value, if the current pixel is the error pixel. An image-processing unit performs image processing in order for the current pixel to be outputted.

Other objects, advantages, and salient features of the invention will become apparent to those skilled in the art from the following detailed description, which taken in conjunction with the annexed drawings, discloses exemplary embodiments of the invention.

BRIEF DESCRIPTION OF THE DRAWINGS

The above and other objects, features, and advantages of certain exemplary embodiments of the present invention will be more apparent from the following description taken in conjunction with the accompanying drawings, in which.

Throughout the drawings, the same drawing reference numeral will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1A:
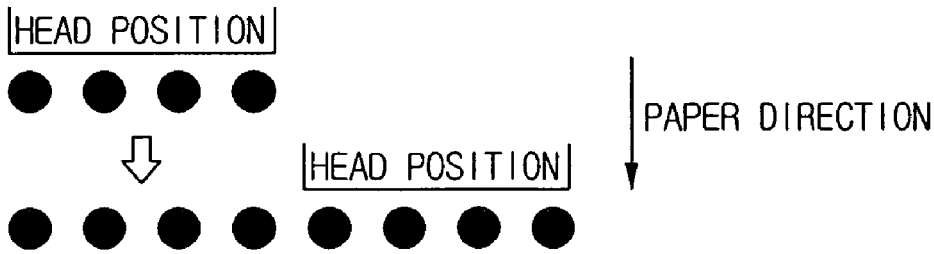
FIG. 1A (PRIOR ART)
FIGS. 1A and 1B are views for explaining a conventional nozzle error correction method.
Figure 1B:
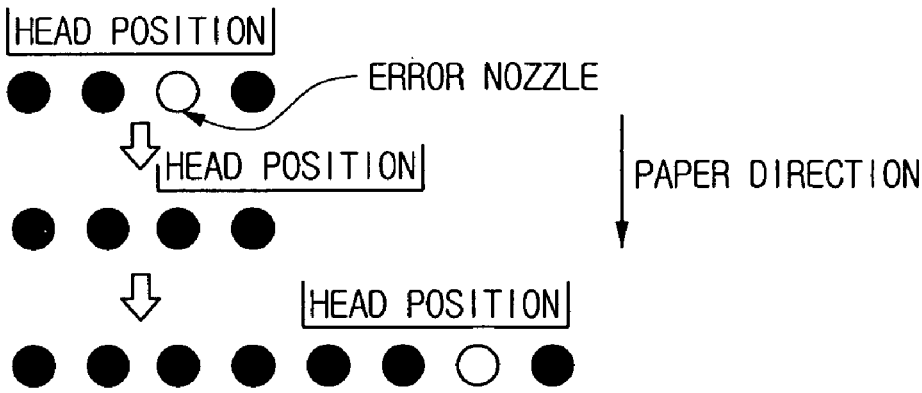
FIG. 1B (PRIOR ART)
Figure 2:
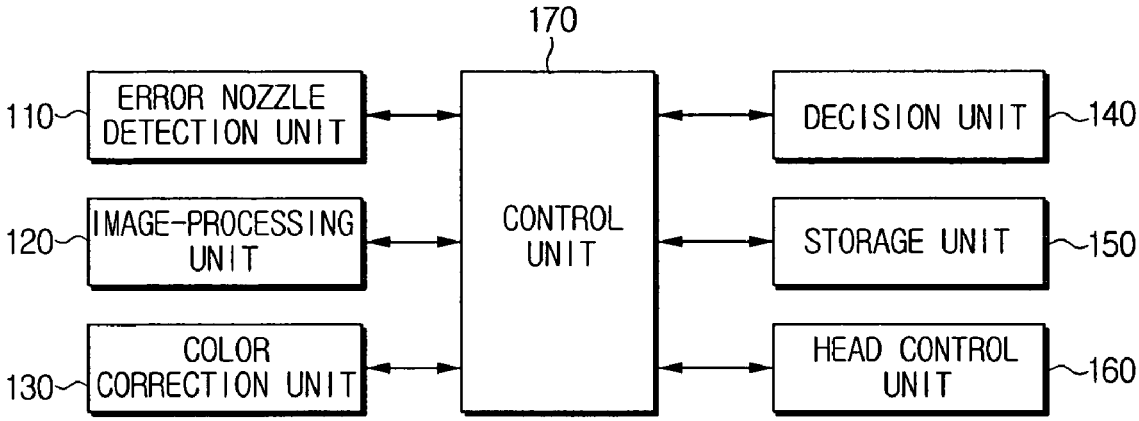
FIG. 2 is a block diagram for illustrating an image-forming apparatus using a nozzle error correction method according to an exemplary embodiment of the present invention.

FIG. 2 is a block diagram for showing an image-forming apparatus using a nozzle error correction method according to an exemplary embodiment of the present invention.

In FIG. 2, the image-forming apparatus using the nozzle error correction method according to an exemplary embodiment of the present invention has an error nozzle detection unit 110, an image-processing unit 120, a color correction unit 130, a decision unit 140, a storage unit 150, a head control unit 160, and a control unit 170.

The error nozzle detection unit 110 detects from a plurality of nozzles, an error nozzle firing an ink amount different from a reference value. A test image can be used to detect an error nozzle. In detail, the error nozzle detection unit 110 checks a position of every dot in the test image, and detects a nozzle number corresponding to each dot. If all dots are expressed in black, the error nozzle detection unit 110 decides that all nozzles fire ink normally. However, if part of the dots is expressed in white, the error nozzle detection unit 110 determines that the nozzles corresponding to the white dots fail to operate normally.

When the error nozzle detection unit 110 detects which nozzles are error nozzles, such as, the nozzles not performing normal ink-firing operations, the error nozzle detection unit 110 stores an error nozzle position information in the storage unit 150.

The decision unit 140 determines whether a current pixel for printout is a last pixel, if input image data is outputted in units of pixels. Further, the decision unit 140 determines whether the current pixel is an error pixel for printout by an error nozzle, using the stored error nozzle position information. If the current pixel is not determined as an error pixel, the decision unit 140 determines whether an error pixel is contained in an area adjacent to the current pixel.

The storage unit 150 stores input image data and image data to be image-processed and printed out, and error nozzle position information detected by the error nozzle detection unit 110. Further, the storage unit 150 can store information of a correction pixel value. The correction pixel value preferably is a correction pixel value of an error nozzle corresponding to a value of an error pixel for printout by using the error nozzle for every pixel of an input image. The correction pixel value information can be stored in a format of a look-up table.

The color correction unit 130 sets a certain value to a channel value corresponding to an error nozzle used for an error pixel, if a current pixel is determined as the error pixel by the decision unit 140. If the current pixel is an error pixel, the color correction unit 130 fixes the channel value corresponding to the error nozzle used for the current pixel. The color correction unit 130 then corrects the error nozzle by controlling the value of a pixel contained in a certain area adjacent to the error pixel.

However, if the current pixel is not an error pixel and an error pixel exists in a certain area around the current pixel, the color correction unit 130 adjusts the value of the current pixel. The adjustment is preferably made using error information, such as, a distance between the current pixel and the error pixel, or a value of the error pixel. If an error pixel exists in a certain area around the current pixel, rather than an error pixel of an error nozzle, the color correction unit 130 adjusts the value of the current pixel to prevent image degradation caused by the error pixel existing around the current pixel. Accordingly, the color correction unit 130 adjusts the value of the current pixel to be similar to the value of the error pixel, taking into account a distance between the current pixel and the error pixel existing in the certain area.

Further, the color correction unit 130 corrects an error pixel of an input image by using stored correction pixel value information, if an output for a specific input can be predicted.

The image-processing unit 120 processes an input image to a format that can be outputted to an image-forming apparatus. For example, the image-processing unit 120 converts the CMYK color space of an input image displayed in RGB and YcrCb color spaces into a color space which can be outputted to image-forming apparatuses. If a pixel of an input image is detected as an error pixel upon color space conversion, the image-processing unit 120 digitizes a correction pixel value to correct an error nozzle. However, if a pixel of an input image is not an error pixel, the image-processing unit 120 digitizes a pixel value of an input image whose pixel values are not corrected.

Further, the image-processing unit 120 performs image enhancement, such as, conversion of the resolution of an input image to a resolution suitable for an image-forming apparatus and gamma correction.

The head control unit 160 inputs a value of a correction error pixel, and controls the head with a series of disposed nozzles so that an image having a nozzle error-corrected pixel value is printed out. Further, if the current pixel is not an error pixel and an error pixel exists in a certain area around the current pixel, the head control unit 160 controls the head to fix a channel value corresponding to an error nozzle for the error pixel.

The control unit 170 controls the overall operations of constituent components in the image-forming apparatus. The control unit 170 stores in the storage unit 150 the error nozzle position information detected by the error nozzle detection unit 110. The control unit 170 also controls the decision unit 140 to determine whether to print out an image using an error nozzle detected at every pixel of an input image, based on the detected error nozzle position information.

Figure 3:
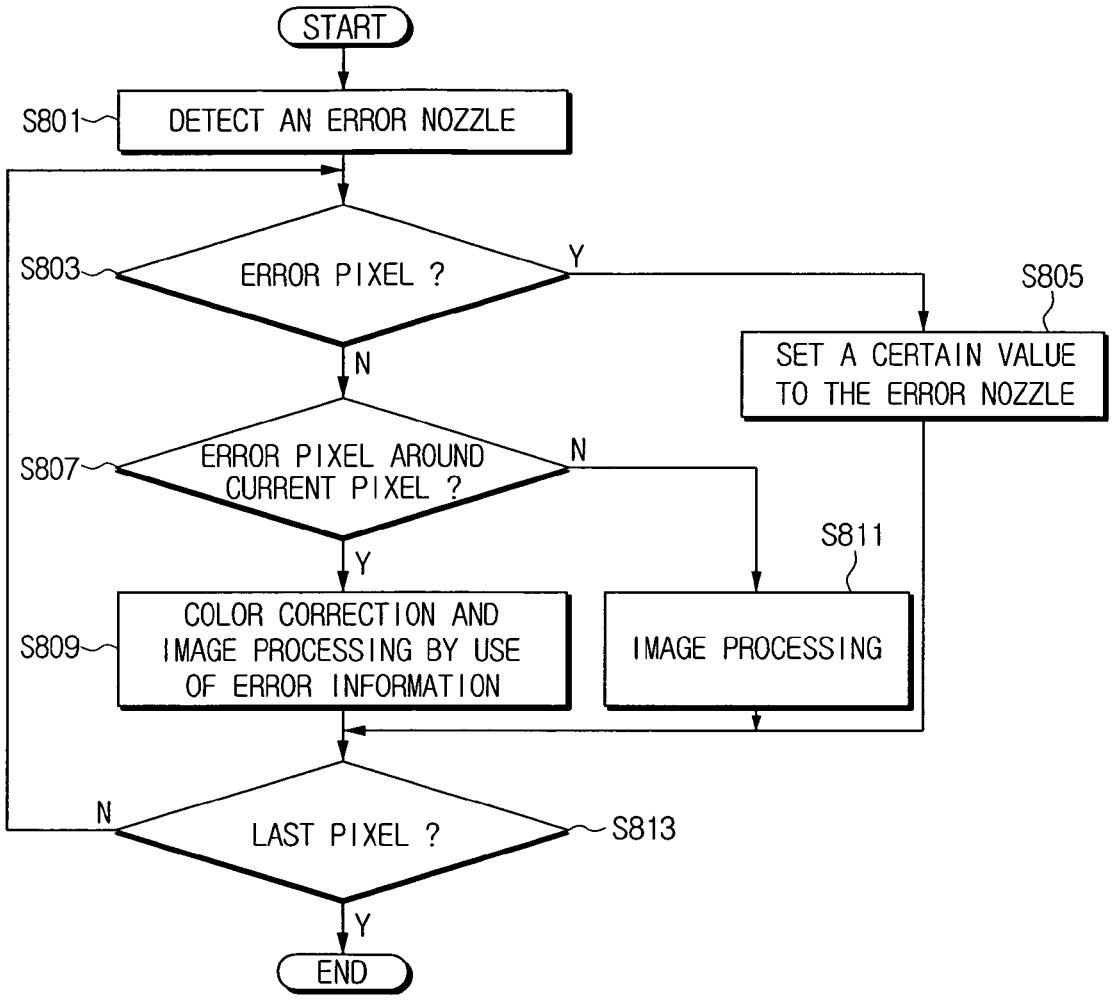
FIG. 3 is a flow chart for explaining a nozzle error correction method according to an exemplary embodiment of the present invention.

FIG. 3 is a flow chart for explaining a nozzle error correction method according to an exemplary embodiment of the present invention. The nozzle error correction method corrects an error nozzle by correcting a value of a pixel existing in a certain area around a pixel printed out by the error nozzle.

In FIG. 3, the nozzle error correction method detects information on a position of an error nozzle firing an ink amount that is different from a reference amount (S801). A test image is preferably used to detect the error nozzle. The position of every dot of the test image is checked, and a number of a nozzle corresponding to each dot is detected. If all dots are expressed in black, it is determined that all the nozzles normally perform the ink-firing operations. However, if part of the dots is expressed in white, it is determined that the nozzles corresponding to the white dots do not perform the normal ink-firing operations. Accordingly, the numbers of the nozzles corresponding to the white dots are detected as error nozzle positions.

Next, it is determined whether the current pixel for printout is an error pixel (S803), which depends on whether the current pixel uses an error nozzle. If the current pixel is printed out by the error nozzle, the error nozzle fires an ink amount different from that of a normal nozzle so that a pixel value becomes different from that of the normal nozzle. Thus, if the current pixel is printed out through an error nozzle, it is determined that the current pixel is an error pixel.

If the current pixel is an error pixel, the color correction unit 130 sets a certain value to a channel value corresponding to an error nozzle used for the current pixel (S805). If the current pixel is determined to be an error pixel, the color correction unit 130 sets a channel value of an error nozzle, used for the current pixel, to a certain value. The color correction unit 130 then adjusts the value of the pixel existing in the certain area around the error pixel in order to prevent degradation of images due to the error nozzle. Further, the color correction unit 130 preferably adjusts the value of the pixel existing in a certain area around the error pixel to be similar to the value of the error pixel, and correct colors of a printout image, thereby correcting the nozzle error.

Since one nozzle fires a small amount of ink and images are outputted with mixture of colors fired by a plurality of nozzles, the color correction unit 130 preferably corrects the error nozzle by adjusting an ink amount of one nozzle used for the error pixel, even though the channel value of a different nozzle is set to a certain value.

For example, if an image outputted from an image-forming apparatus is formed in the CMYK color space and the error nozzle corresponds to a C-channel, the value of the C-channel of the error nozzle is fixed to a certain value.

However, if the current pixel is not an error pixel, it is determined whether the error pixel is contained in a certain area around the current pixel (S807).

If an error pixel is contained in the certain area around the current pixel, the image-processing unit 120 uses error information to adjust a value of the current pixel, and processes an image so that the current pixel is outputted (S809). If the error pixel exists in the area around the current pixel, the image-processing unit 120 preferably adjusts the value of the current pixel to become similar to the error pixel by using the error information. As a result, degradation of an output image caused by the error pixel is reduced, thereby correcting the nozzle error.

In an exemplary embodiment of the present invention, the error information is preferably a distance between the current pixel and an error pixel existing in a certain area around the current pixel, a value of the error pixel, or a value of the current pixel. The value of the current pixel can be adjusted to be similar to a value of the error pixel as the current pixel is closer to the error pixel in distance. The value of the error pixel is also adjusted in consideration of the value of the current pixel.

For example, if the current pixel is an error pixel that is black in color, the value of a pixel existing in a certain area is preferably adjusted to the black color similar to the error pixel. As a result, the error pixel appears as a color similar to the black color as outputted by a normal nozzle.

However, if any error pixel is not included in the certain area around the current pixel, image processing is performed in order for the current pixel to be outputted without any adjustment of a value of the current pixel (S811).

Next, it is determined whether the current pixel is the last pixel after the image processing in order to enable the current pixel to be outputted (S813). If the current pixel is not the last pixel, step S803 is repeated to image-process the pixel for printout. However, if the current pixel is the last pixel, an output of an input image ends.

Figure 4:
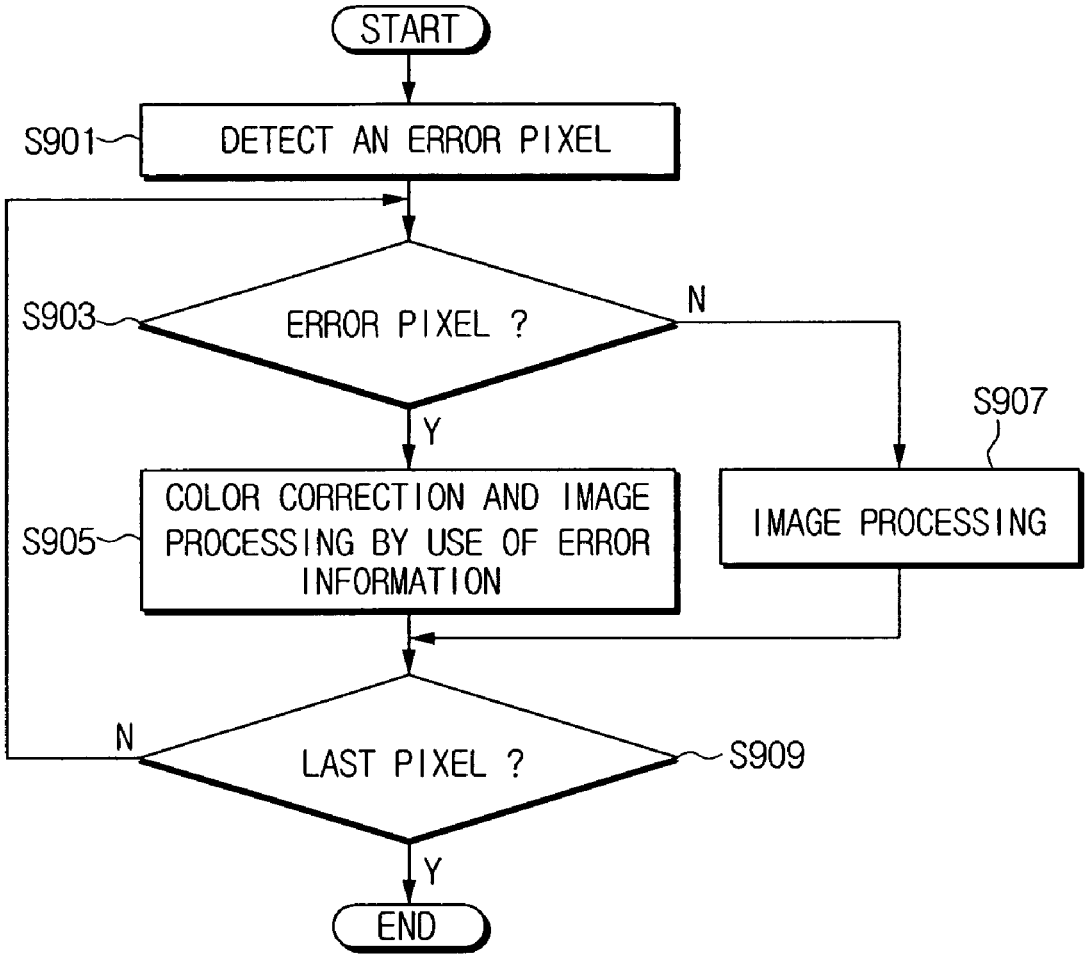
FIG. 4 is a flow chart for describing a nozzle error correction method according to an exemplary embodiment of the present invention.

FIG. 4 is a flow chart for describing a nozzle error correction method according to an exemplary embodiment of the present invention, which corrects an error nozzle by correcting a value of an output error pixel of an error nozzle. Therefore, the output of a specific input using the error nozzle can be predicted. Moreover, with respect to the same input, the nozzle error correction method can also be applied if an ink amount is fired relatively large or small compared to a normal nozzle.

In FIG. 4, information on a position of an error nozzle firing an ink amount different from a reference amount is detected (S901). The test image can be used to detect the error nozzle. The position of every dot of the test image is checked, and the number of a nozzle corresponding to each dot is detected. If all dots are expressed in black, it is determined that all the nozzles have normal ink-firing operations. However, if part of the dots is expressed in white, it is determined that the nozzles corresponding to the white dots do not have the normal ink-firing operations. Accordingly, the number of the nozzles corresponding to the white dots is detected as error nozzle positions.

Next, it is determined whether the current pixel for output is an error pixel (S903), which depends on whether the error nozzle is used for the current pixel for output. If the current pixel is outputted through an error nozzle, the current pixel has a different pixel value from the pixel value of a normal nozzle. Therefore, it is determined that the current pixel is an error pixel if the current pixel is outputted through an error nozzle.

If the current pixel is an error pixel, error information is used to perform color correction and image-processing of the error pixel (S905). Moreover correction pixel value information is used to perform color correction of the current pixel and image processing is performed in order for the current pixel to be outputted to an image-forming apparatus.

In an exemplary embodiment of the present invention, the information on correction pixel value refers to a table for pixel values of a nozzle error-corrected input image corresponding to each pixel value of the input image for output by an error nozzle. Since an output of a specific input using an error nozzle can be predicted, correction is made on a difference between the predicted output pixel value and an output pixel value at the time a normal nozzle is used. Thus, a nozzle error-corrected output is obtained.

However, if the current pixel is not an error pixel, image-processing is preferably made in order for the current pixel to be outputted without any color correction of the current pixel (S907).

Next, it is determined whether the current pixel is the last pixel after the current pixel is image-processed for output (S909). If the current pixel is not the last pixel, step S903 is repeated to image-process an output pixel. However, if the current pixel is the last pixel, an output of an input image ends.

As stated above with reference to FIGS. 3 and 4, in order to correct a nozzle error caused by an output error pixel of an error nozzle, FIG. 3 illustrates a normal output pixel adjusted to have a pixel value similar to the error pixel by using a normal nozzle around the error pixel. Also, a value of the error pixel is set to a certain value by fixing a channel value corresponding to the error nozzle. Thus, the pixel values around the error pixel are corrected in terms of the color of the error pixel as a result of the adjusted normal pixels.

However, FIG. 4 illustrates a method for not correcting the values of the normal pixels around an error pixel. However, the value of the error pixel is adjusted in order to correct an error nozzle. For example, FIG. 4 shows adjusting and correcting the error nozzle to a pixel value at the time the error pixel is outputted by a normal nozzle.

As aforementioned, since information on an output image is adjusted to correct an error nozzle, exemplary embodiments of the present invention do not require additional mechanical operations of the head. Accordingly, print speed is prevented from being degraded, and the life span of the head is prevented from being shortened.

Further, exemplary embodiments of the present invention can be applied to disabling error nozzles to be corrected, by mechanically moving a position of the head in the image-forming apparatuses with a full-type head that uses as many nozzles as a paper size for printout.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. An image-forming apparatus that uses a nozzle error correction method, the image-forming apparatus comprising:

a full-type head having a plurality of nozzles disposed in series, as a single line of nozzles, to fit a paper size, wherein the full-type head has a fixed position and during printing, does not move with respect to the paper, in the longitudinal direction of the single line of nozzles;

an error nozzle detection unit for detecting from the plurality of nozzles disposed in series, a position of an error nozzle firing an ink amount that is different from a reference value;

a decision unit for determining from an input image, whether a current pixel for output is an output error pixel of the error nozzle, and determining whether an error pixel exists in a certain area around the current pixel;

a color correction unit for setting a channel value of the error nozzle to a certain value, adjusting an ink amount fired by a surrounding nozzle on the same print head as the error nozzle, thereby adjusting a value of a pixel in the certain area around the current pixel to be closer to a value of the error pixel, without diffusing the error value of the error pixel to the pixel in the certain area around the current pixel, if the current pixel is the error pixel using the error nozzle, and if the current pixel is not the error pixel and an error pixel using the error nozzle exists in the certain area around the current pixel, adjusting an ink amount fired by a surrounding nozzle on the same print head as the error nozzle based on error information, thereby adjusting a value of the current pixel to be closer to the value of the error pixel, without diffusing the error value of the error pixel to the current pixel;

an image-processing unit for performing image processing in order for the current pixel to be outputted, wherein the surrounding nozzle is at least one of the plurality of nozzles disposed in series.

2. The image-forming apparatus claimed in claim 1, further comprising a storage unit for storing input image data, position information of the detected error nozzle, and a certain channel value of the error nozzle.

3. The image-forming apparatus as claimed in claim 1, wherein the error information is at least one of a distance between the current pixel and an error pixel existing in the certain area around the current pixel, a value of the error pixel existing in the certain area, or a value of the current pixel.

4. An image-forming apparatus that uses a nozzle error correction method, the image-forming apparatus comprising:

a full-type head having a plurality of nozzles disposed in series, as a single line of nozzles, to fit a paper size, wherein the full-type head has a fixed position and during printing, does not move with respect to the paper, in the longitudinal direction of the single line of nozzles;

an error nozzle detection unit for detecting from the plurality of nozzles disposed in series, a position of an error nozzle firing an ink amount that is different from a reference value;

a decision unit for determining from an input image, whether a current pixel for output is an output error pixel of the error nozzle by using the error nozzle position information;

a storage unit for storing the error nozzle position information and information of a correction pixel value for each error pixel corresponding to the error nozzle position;

a color correction unit for correcting a value of the current pixel by using the information of a correction pixel value and adjusting an ink amount fired by a surrounding nozzle on the same print head as the error nozzle, thereby adjusting a value of a pixel in the certain area around the current pixel to be closer to a value of the error pixel, without diffusing the error value of the error pixel to the pixel in the certain area around the current pixel, if the current pixel is the error pixel using the error nozzle; and an image-processing unit for performing image processing in order for the current pixel to be outputted, wherein the surrounding nozzle is at least one of the plurality of nozzles disposed in series.

* * * * *